US012264603B2

(12) United States Patent
Karic

(10) Patent No.: US 12,264,603 B2
(45) Date of Patent: Apr. 1, 2025

(54) CAMSHAFT PHASER HAVING NON-RETURN VALVES

(71) Applicant: Schaeffler Technologies AG & Co. KG, Herzogenaurach (DE)

(72) Inventor: Branimir Karic, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 18/708,610

(22) PCT Filed: Nov. 11, 2022

(86) PCT No.: PCT/DE2022/100841
§ 371 (c)(1),
(2) Date: May 9, 2024

(87) PCT Pub. No.: WO2023/088515
PCT Pub. Date: May 25, 2023

(65) Prior Publication Data

US 2025/0027432 A1 Jan. 23, 2025

(30) Foreign Application Priority Data

Nov. 19, 2021 (DE) ..... 10 2021 130 311.7

(51) Int. Cl.
*F01L 1/344* (2006.01)
*F01L 1/46* (2006.01)

(52) U.S. Cl.
CPC ..... *F01L 1/3442* (2013.01); *F01L 1/46* (2013.01); *F01L 2001/34426* (2013.01);
(Continued)

(58) Field of Classification Search
CPC ..... F01L 1/3442; F01L 2001/34426; F01L 2001/3443; F01L 2001/34433; F01L 2001/34446; F01L 2001/34483; F01L 1/46
(Continued)

(56) References Cited

U.S. PATENT DOCUMENTS 10,107,153 B2 10/2018 Boese et al.
2018/0355767 A1* 12/2018 Boese ..... F01L 1/24

FOREIGN PATENT DOCUMENTS

DE 102012201550 A1 8/2013
DE 102012201553 A1 8/2013
(Continued)

*Primary Examiner* — Jorge L Leon, Jr.
(74) *Attorney, Agent, or Firm* — Matthew V. Evans

(57) ABSTRACT

The disclosure relates to a camshaft phaser for adjusting a phase position between a crankshaft and a camshaft of a motor vehicle. The camshaft phaser comprises a stator, a rotor which is rotatable in relation thereto, and working chambers which are formed between the stator and the rotor and each of which are subdivided by a blade of the rotor into a first sub-chamber and a second sub-chamber. For storage of the hydraulic fluid, the camshaft phaser has a reservoir which is connected to the sub-chambers via one non-return valve each, in order that when a negative pressure prevails in one of the sub-chambers, hydraulic fluid is fed from the reservoir to this sub-chamber. The non-return valves are preloaded in such a way that they only open when a pressure within an associated sub-chamber falls below a predetermined negative pressure.

18 Claims, 3 Drawing Sheets

(52) U.S. Cl.
CPC ..... *F01L 2001/3443* (2013.01); *F01L 2001/34433* (2013.01); *F01L 2001/34446* (2013.01); *F01L 2001/34483* (2013.01)

(58) Field of Classification Search
USPC ..... 123/90.17
See application file for complete search history.

(56) References Cited

FOREIGN PATENT DOCUMENTS

| | | | | |
|---|---|---|---|---|
| DE | 102013221268 | A1 | | 4/2015 |
| DE | 102016218793 | A1 | | 6/2017 |
| DE | 102017102777 | A1 | | 8/2018 |
| DE | 102017113648 | A1 | * | 12/2018 |
| DE | 102017115094 | A1 | * | 1/2019 |
| DE | 102020105518 | A1 | | 9/2021 |
| WO | 2014202069 | A1 | | 12/2014 |
| WO | WO-2019210903 | A1 | * | 11/2019 |

* cited by examiner

CAMSHAFT PHASER HAVING NON-RETURN VALVES

CROSS-REFERENCE TO RELATED APPLICATIONS

This application is the U.S. National Phase of PCT Application No. PCT/DE2022/100841 filed on Nov. 11, 2022, which claims priority to DE 10 2021 130 311.7 filed on Nov. 19, 2021, the entire disclosures of which are incorporated by reference herein.

TECHNICAL FIELD

The disclosure relates to a camshaft phaser for adjusting a phase position between a crankshaft and a camshaft of a motor vehicle.

BACKGROUND

Such camshaft phasers of the vane type, which have a hydraulic fluid reservoir, are already known from the prior art. Such a camshaft phaser is known, for example, from DE 10 2016 218 793 A1.

With camshaft phasers of this type, the alternating torques acting on the camshaft can be used to adjust the angle of rotation of the camshaft, which is also referred to as a camshaft torque actuated (CTA) adjustment. In the process, the hydraulic medium/hydraulic fluid is directed/drawn into a sub-chamber in which a negative pressure prevails due to the alternating torques acting on the camshaft. In addition, an external hydraulic medium supply, such as a pump, can be used to adjust the angle of rotation of the camshaft, which is also referred to as an oil pressure actuated (OPA) adjustment. In this case, one sub-chamber is pressurized by the hydraulic medium supply and the other sub-chamber is connected to a pressureless tank/reservoir for the discharge of hydraulic medium.

The advantage of an adjustment by means of the camshaft torques is that only a very low hydraulic medium flow is required. However, adjustment via the camshaft torques is only possible if the alternating torques acting on the camshaft are sufficiently large, since the adjustment speeds that can be achieved at low alternating torques are too low. The advantage of performing an adjustment via the oil pressure is that the adjustment can be easily controlled even with small adjustment shifts at low adjustment speeds. However, a relatively large flow of hydraulic medium, which must be supplied via the external hydraulic medium supply, is required, which has a negative effect on the necessary installation space.

To avoid the disadvantages of the two types of adjustment (OPA and CTA), so-called smartphasers have been developed, the main advantage of which is that they combine the principles of OPA and CTA adjustment in order to ensure higher adjustment speeds with reduced quantities of hydraulic medium. In addition, the noise and pressure surges during adjustment can be damped when using a smartphaser.

A smartphaser is an open system in which the hydraulic fluid is drawn from the reservoir, which has the disadvantage that air can be drawn from the reservoir and that hydraulic fluid is also drawn from the reservoir in a controlled position/holding position of the camshaft phaser.

However, the prior art always suffers the disadvantage that, in camshaft phasers known to date, which combine the OPA and CTA adjustment principles, as soon as a negative pressure (however small) is generated in one of the two sub-chambers compared to an ambient pressure, the hydraulic fluid immediately flows into the corresponding sub-chamber from the reservoir. Thus, in the controlled position/holding position, in which the sub-chambers alternatingly, i.e., with each cam actuation, fall below the ambient pressure, hydraulic fluid is drawn from the reservoir into the sub-chambers, which, depending on the duration of the holding position, can lead to a complete emptying of the reservoir. However, if the reservoir is emptied, it is no longer possible to hold the camshaft phaser in a certain position without large oscillations, so the effect of hydraulic fluid being drawn in from the reservoir in the controlled position must be avoided at all costs.

SUMMARY

It is therefore the object of the disclosure to avoid or at least to mitigate the disadvantages of the prior art. In particular, the goal is to provide a camshaft phaser that is particularly robust and functions perfectly under all boundary conditions, in particular in the controlled position.

The object of the disclosure is achieved by a camshaft phaser having the features described herein.

In particular, this object is achieved in a generic device according to the disclosure in that the non-return valves are preloaded in such a way that they only open when the pressure in the associated sub-chamber falls below a predetermined negative pressure. In other words, the non-return valves are preloaded with a certain preload force (against their opening direction), which only allows the non-return valves to open when the pressure drops below a certain limit. This means that the non-return valves are closed above the predetermined negative pressure and open when the predetermined negative pressure is reached. It is therefore ensured that hydraulic fluid is only fed from the reservoir into the corresponding sub-chamber if a sufficiently high negative pressure (specifically a higher negative pressure than the predetermined negative pressure) prevails.

This has the advantage that the preloaded non-return valves can withstand up to the predetermined negative pressure in the corresponding sub-chamber, i.e., remain closed, so that it is prevented that hydraulic fluid is drawn in from the reservoir in the event of a slight negative pressure (alternating in the sub-chambers), i.e., in particular in controlled operation. In this way, inefficient pump-overs can advantageously be avoided, which prevents rapid emptying of the reservoir and leads to an improvement in controlled operation.

According to an example embodiment, the predetermined negative pressure can be between −0.15 bar and −1 bar. In further example embodiments, the predetermined negative pressure can be between −0.35 bar and −0.95 bar, or between −0.55 bar and −0.9 bar, or between −0.7 bar and −0.85 bar. In a further aspect, the predetermined negative pressure can be −0.8 bar. In other words, the predetermined negative pressure is selected such that it does not fall below the predetermined negative pressure in the controlled position/in the holding position. This prevents the reservoir from emptying in the holding position. In this regard, experience has shown that the stated values are suitable.

According to an example embodiment, the predetermined negative pressure can essentially correspond to a saturation pressure of the camshaft phaser. This means that the predetermined negative pressure is a design criterion of the camshaft phaser and is can be defined slightly ahead of the cavitation limit. This, on the one hand, avoids undesired emptying of the reservoir and, on the other hand, also ensures that the performance of the camshaft phaser, i.e., in particular the adjustment speed, remains unaffected at both high and low temperatures.

According to an example embodiment, the camshaft phaser can have a non-return valve plate on which the non-return valves are formed and are resiliently mounted via a connecting region, wherein the connecting region is plastically deformed (in order to introduce the preload). This means that the non-return valves are/were deformed in the plastic range (during assembly), in particular against their opening direction, in such a way that they only open when the pressure falls below the predetermined negative pressure. This makes it particularly easy to introduce the preload force.

According to a further development of an example embodiment, the connecting region can be heat-treated (for stress-free formation of the plastic deformation). This has the advantage that the stresses induced by the deformation can be compensated or reduced so that the plastic deformation of the connecting region does not have a detrimental effect on the breaking strength and/or service life of the non-return valves.

According to a further development of an example embodiment, the non-return valves can be plastically deformed from their closed position against their opening direction and mounted in such a way that the non-return valves are pressed into their closed position. This means that the preload is generated during assembly. In particular, the preload is generated by the non-return valves being pressed into their closed position by contact with a (for example stator-fixed) cover of the camshaft phaser.

According to an example embodiment, the camshaft phaser can have one spring for each non-return valve for introducing the preload, wherein the spring is arranged such that its spring force counteracts an opening of the associated non-return valve. This means that the preload of the non-return valves can also be induced by a preload spring in order to allow the associated non-return valve to open only from the predetermined negative pressure. This means that the preload force can be influenced in a simple manner by selecting the appropriate spring stiffness, etc.

According to a further development of an example embodiment, the stator can have recesses, in each of which one of the springs is accommodated. This means that the non-return valves can be preloaded by the springs accommodated in the stator. This has the advantage of ensuring that the springs are held securely.

According to a further development of an example embodiment, the camshaft phaser can have a preload pin for each non-return valve, which can be accommodated in the stator and arranged between the non-return valves and the springs in such a way that it transmits the spring force of the springs to the non-return valves. The arrangement of an additional preload pin offers further design possibilities, as the spring does not have to contact the non-return valve directly.

In other words, the disclosure relates to a camshaft phaser, in particular a so-called smartphaser, in which preloaded non-return valves are used. These can be formed in a non-return valve plate and, in an example embodiment, can withstand a negative pressure from an associated (sub-)chamber of max −1.0 bar, i.e., remain closed up to this negative pressure, in order to achieve an improvement in controlled operation and avoid inefficient pump-overs of hydraulic fluid/oil. The strength of the preload, i.e., the predetermined negative pressure, is a design criterion, wherein −0.8 bar may be suitable. Larger preloads at which the non-return valve can withstand more than −1 bar negative pressure, for example −1.5 bar negative pressure, i.e., remains closed up to this negative pressure due to the preload, impair the function of the camshaft phaser, as a desired pump-over from the reservoir into the (sub-)chamber to be reduced no longer works. Thus, according to the disclosure, an improvement is proposed in the smartphaser adjustment system with regard to the problem of suddenly increased oscillations in the controlled position, which can occur due to the emptying of the reservoir. In particular, the preloading of the non-return valves can be realized by a special deformation of an existing non-return valve disc or by additional pins and springs acting on the non-return valves.

BRIEF DESCRIPTION OF THE DRAWINGS

The disclosure is explained below with the aid of drawings. In the figures.

DETAILED DESCRIPTION

The figures are merely schematic in nature and serve solely for understanding the disclosure. Identical elements are provided with the same reference symbols. The features of the individual embodiments can be interchanged.

Figure 1:
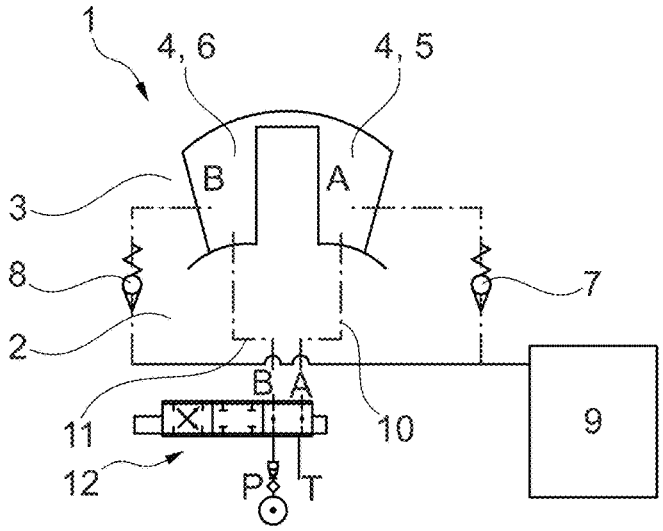
FIG. 1 shows a schematic representation of a camshaft phaser.

FIG. 1 shows a schematic representation of a camshaft phaser 1 according to the disclosure. The camshaft phaser 1 is used to adjust a phase position between a crankshaft and a camshaft of a motor vehicle. The camshaft phaser 1 has a stator 2. In particular, the stator 2 can be rotationally coupled or rotationally couplable to the crankshaft. The camshaft phaser 1 has a rotor 3. In particular, the rotor 3 can be rotationally coupled or rotationally couplable to the camshaft. The rotor 3 is rotatable relative to the stator 2 and can be arranged radially within and concentric to the stator 2. The camshaft phaser 1 has working chambers 4 which are formed between the stator 2 and the rotor 3 which are each subdivided by a blade of the rotor 3 into a first sub-chamber 5 (A chamber) and a second sub-chamber 6 (B chamber). Hydraulic fluid can be applied to the sub-chambers 5, 6 in order to adjust the rotor 3 relative to the stator 2.

For storage of the hydraulic fluid, the camshaft phaser 1 has a reservoir 9 which is connected to the sub-chambers 5, 6 via one non-return valve 7, 8 each in order that when a negative pressure prevails in one of the sub-chambers 5, 6, the hydraulic fluid is fed from the reservoir 9 to this sub-chamber 5, 6. Thus, hydraulic fluid is fed to the first sub-chamber 5 from the reservoir 9 via the first non-return valve 7 when a negative pressure prevails in the first sub-chamber 5, and hydraulic fluid is fed to the second sub-chamber 6 from the reservoir 9 via the second non-return valve 8 when a negative pressure prevails in the second sub-chamber 6.

For oil pressure actuated adjustment, the two sub-chambers 5, 6 are each connected to a central valve 12 via a working channel 10, 11. Thus, depending on the switching position of the central valve 12, the first sub-chamber 5 is connected to a pump for pressurization or to a tank for pressure relief via the first working channel 10, and, depending on the switching position of the central valve 12, the second sub-chamber 6 is connected to the pump for pressurization or to the tank for pressure relief via the second working channel 11.

According to the disclosure, the non-return valves 7, 8 are preloaded in such a way that they only open when the pressure in the associated sub-chamber 5, 6 falls below a predetermined negative pressure. This means that the non-return valves 7, 8 are preloaded with a certain preload force against their opening direction, which only allows the non-return valves 7, 8 to open when the pressure drops below the predetermined negative pressure, i.e., when the negative pressure in the associated sub-chamber 5, 6 is sufficiently high.

Figure 2:
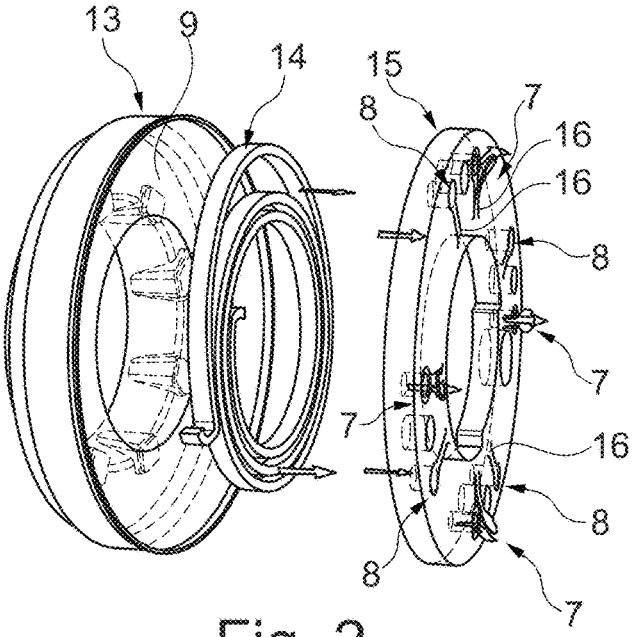
FIG. 2 shows a perspective view of a part of the camshaft phaser.
Figure 3:
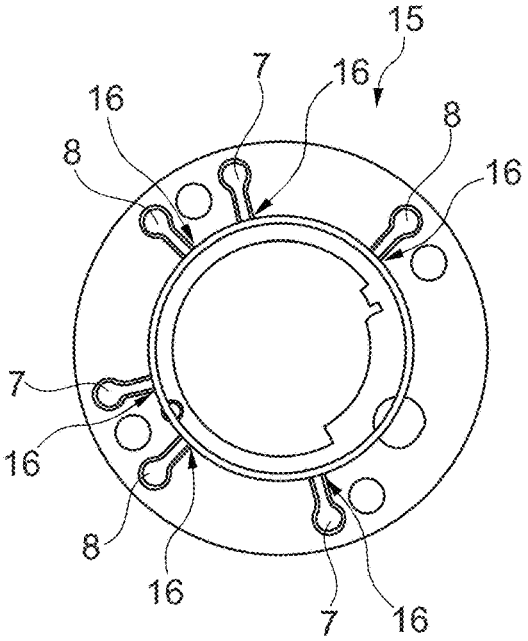
FIGS. 3 to 6 show different schematic representations of a part of the camshaft phaser in a first embodiment.

FIG. 2 shows a perspective view of a part of the camshaft phaser 1. The reservoir 9 is formed in a cover 13 of the camshaft phaser 1 so that the hydraulic fluid can be fed axially via the two non-return valves 7, 8 into the corresponding sub-chambers 5, 6. In addition, a return spring 14 is arranged in the cover 13.

The camshaft phaser 1 has a non-return valve plate 15 on which the non-return valves 7, 8 are formed. The non-return valves 7, 8 are resiliently mounted via a connecting region 16 so that they can be (elastically) bent in their opening direction in order to allow hydraulic fluid to flow from the reservoir 9 into the corresponding sub-chamber 5, 6.

Figure 4:
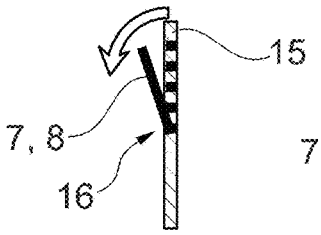
Figure 5:
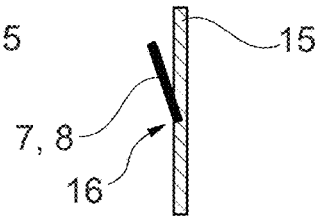
Figure 6:
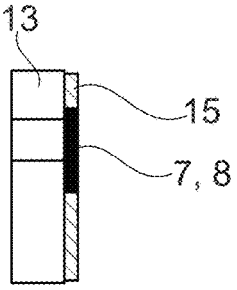

FIGS. 3 to 6 show a first embodiment of the camshaft phaser 1. In order to introduce the preload to the non-return valves 7, 8, the connecting region 16 of each non-return valve 7, 8 is plastically deformed, in particular against the opening direction. The punched non-return valves 7, 8 in the non-return valve plate 15 are bent at the connecting region 16 up to their plastic range (FIG. 4). After bending, the non-return valve plate 15 is thermally treated in order to eliminate and/or reduce the stresses caused by the deformation, so that the connecting region 16 remains stress-free (FIG. 5). During assembly, the non-return valve plate 15 is mounted (between the stator 2 and the cover 13) so that it rests against the cover 13, so that the preload is generated during assembly (FIG. 6).

Figure 7:
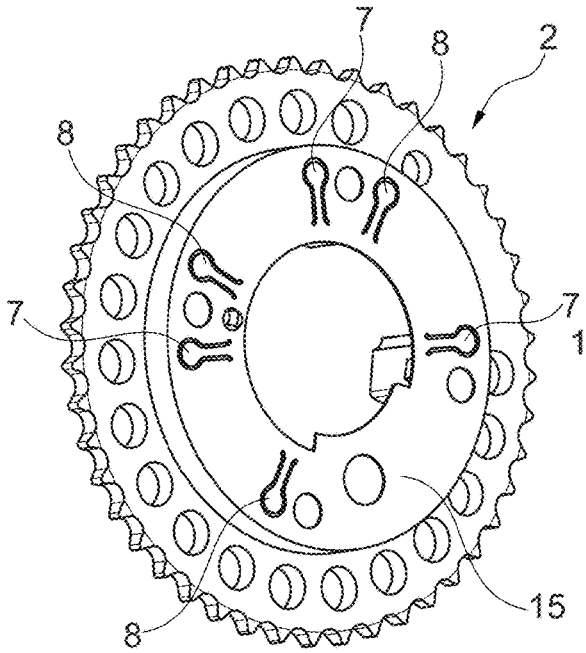
FIGS. 7 to 9 show different schematic representations of a part of the camshaft phaser in a second embodiment.
Figure 8:
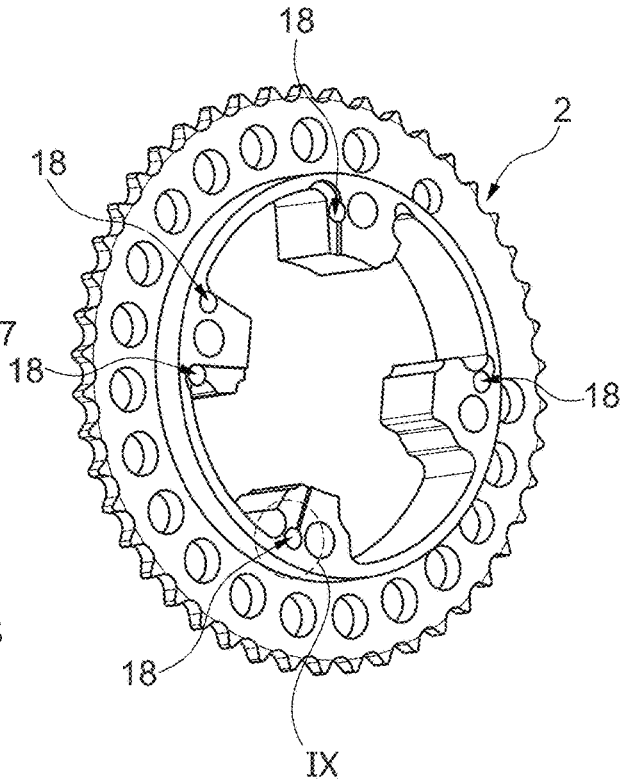
Figure 9:
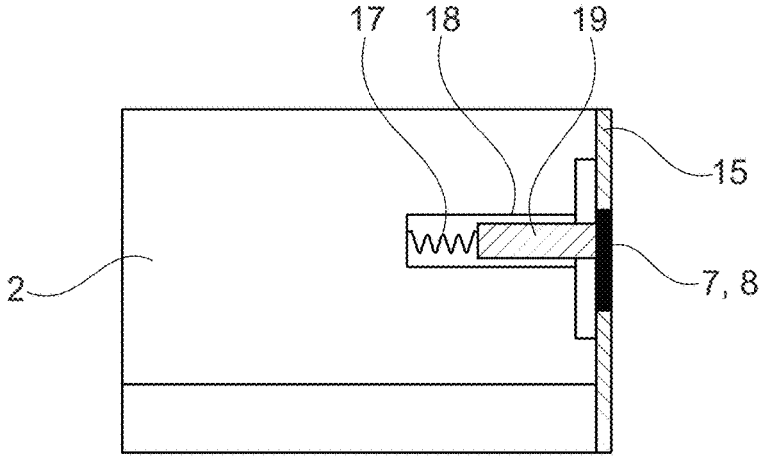

FIGS. 7 to 9 show a second embodiment of the camshaft phaser 1. In order to introduce the preload to the non-return valves 7, 8, preload springs 17 are installed in the camshaft phaser 1, which apply the preload to the non-return valves 7, 8, in particular against their opening direction. In particular, the preload springs 17 are installed in the stator 2. For this purpose, the stator 2 has (axial) recesses 18. A preload pin 19 is arranged in each of the recesses 18, which is arranged between the associated non-return valve 7, 8 and the associated preload springs 17 in such a way that it transmits the spring force of the preload spring 17 to the non-return valve 7, 8 (detailed view IX in FIG. 9).

Figure 10:
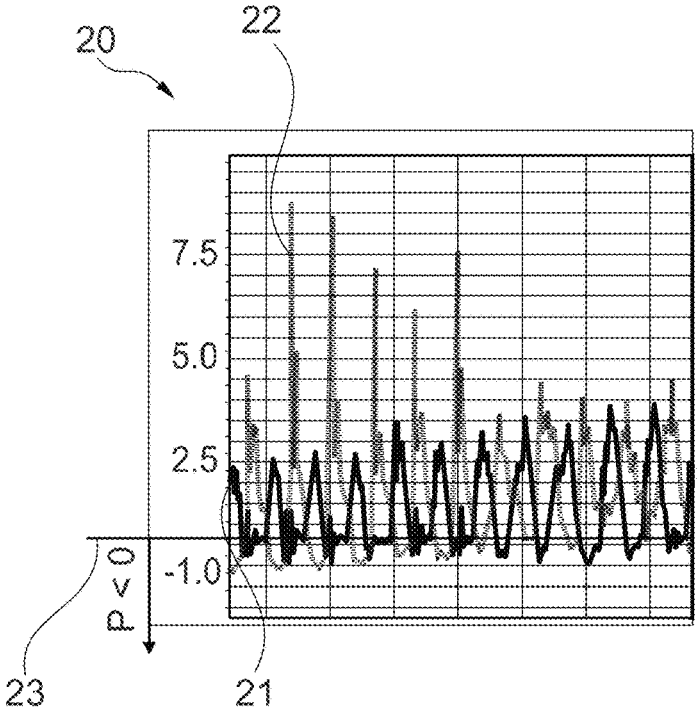
FIG. 10 shows a graph showing a pressure curve over time in sub-chambers of the camshaft phaser.

FIG. 10 shows a graph 20 which shows a course over time of the pressure in the first sub-chamber 5 using a curve 21 and the pressure in the second sub-chamber 6 using a curve 22 during controlled operation of the camshaft phaser 1. It can be seen here that the pressure in the two sub-chambers 5, 6 drops below an ambient pressure 23 in an alternating manner. The predetermined negative pressure can be selected such that it is not reached during controlled operation of the camshaft phaser 1.

Figure 11:
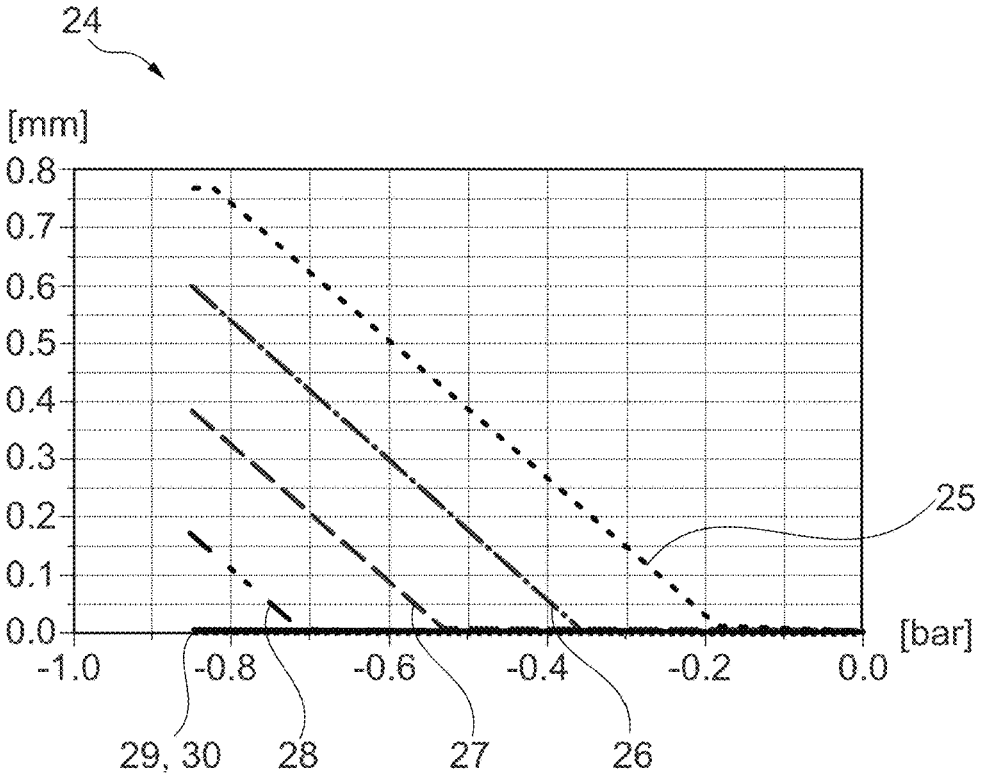
FIG. 11 shows a graph showing the relationship between a preload force acting on the non-return valves of the camshaft phaser and the pressure required to open the non-return valves.

FIG. 11 shows a graph 24 which shows a relationship between a preload force acting on the non-return valves 7, 8 and the pressure required to open the non-return valves 7, 8. As the (negative) pressure increases, the opening of the non-return valve 7, 8 increases. A first curve 25 shows a relationship of a non-return valve to which a preload force of 0.2 N is applied, wherein the non-return valve opens when a negative pressure of approximately −0.15 bar is reached. A second curve 26 shows a relationship of a non-return valve to which a preload force of 0.4 N is applied, wherein the non-return valve opens when a negative pressure of approximately −0.35 bar is reached. A third curve 27 shows a relationship of a non-return valve to which a preload force of 0.6 N is applied, wherein the non-return valve opens when a negative pressure of approximately −0.55 bar is reached. A fourth curve 28 shows a relationship of a non-return valve to which a preload force of 0.8 N is applied, wherein the non-return valve opens when a negative pressure of approximately −0.7 bar is reached. A fifth curve 29 shows a relationship of a non-return valve to which a preload force of 1.0 N is applied, wherein the non-return valve does not yet open when a negative pressure of approximately −0.85 bar is reached. A sixth curve 30 shows a relationship of a non-return valve to which a preload force of 1.2 N is applied, wherein the non-return valve does not yet open when a negative pressure of approximately −0.85 bar is reached.

In example embodiments, the predetermined negative pressure can be between −0.15 bar and −1 bar, between −0.35 bar and −0.95 bar, between −0.55 bar and −0.9 bar, or between −0.7 bar and 0.85 bar. The selection of the predetermined negative pressure as −0.8 bar has proven to be suitable. In particular, the predetermined negative pressure can essentially correspond to a saturation pressure of the camshaft phaser 1.

List of Reference Symbols

1 Camshaft phaser
2 Stator
3 Rotor
4 Working chamber
5 First sub-chamber
6 Second sub-chamber
7 First non-return valve
8 Second non-return valve
9 Reservoir
10 First working channel
11 Second working channel
12 Central valve
13 Cover
14 Return spring
15 Non-return valve plate
16 Connecting region
17 Preload spring
18 Recess
19 Preload pin
20 Graph
21 Oil pressure curve
22 Oil pressure curve
23 Ambient pressure
24 Graph
25 Preload force curve
26 Preload force curve
27 Preload force curve

28 Preload force curve
29 Preload force curve
30 Preload force curve

The invention claimed is:

1. A camshaft phaser for adjusting a phase position between a crankshaft and a camshaft of a motor vehicle, the camshaft phaser comprising:

a stator, a rotor configured to rotate relative to the stator, the rotor including a plurality of blades, a plurality of working chambers formed between the stator and the rotor, the plurality of blades respectively dividing each working chamber into a first sub-chamber and a second sub-chamber which are configured to receive hydraulic fluid so as to rotate the rotor relative to the stator, and a reservoir configured to store the hydraulic fluid, the reservoir fluidly connected to:

i) each first sub-chamber via a respective first non-return valve so as to feed the hydraulic fluid to each first sub-chamber when a negative pressure is present in each first sub-chamber, and p2 ii) each second sub-chamber via a respective second non-return valve so as to feed the hydraulic fluid to each second sub-chamber when a negative pressure is present in each second sub-chamber, wherein selected non-return valves are preloaded, the selected non-return valves including:

each first non-return valve being preloaded so as to remain closed until the negative pressure in each first sub-chamber decreases below a predetermined negative pressure thereby opening each first non-return valve, and/or each second non-return valve being preloaded so as to remain closed until the negative pressure in each second sub-chamber decreases below the predetermined negative pressure thereby opening each second non-return valve, wherein the predetermined negative pressure corresponds to a saturation pressure of the camshaft phaser.

2. The camshaft phaser according to claim 1, wherein the saturation pressure is between −0.15 bar and −1 bar.

3. The camshaft phaser according to claim 2, wherein the saturation pressure is −0.8 bar.

4. The camshaft phaser according to claim 1, further comprising a non-return valve plate on which each non-return valve is formed, wherein each non-return valve includes a connecting region resiliently attached to the non-return valve plate, and wherein the selected non-return valves are preloaded via a plastic deformation at the connecting region.

5. The camshaft phaser according to claim 4, wherein the connecting region of each selected non-return valve is heat-treated so as to reduce stresses caused by the plastic deformation.

6. The camshaft phaser according to claim 4, wherein the selected non-return valves are plastically deformed in a direction away from an open position so as to be pressed into a closed position when the camshaft phaser is assembled.

7. The camshaft phaser according to claim 6, wherein the reservoir is formed in a cover configured to press the selected non-return valves into the closed position.

8. The camshaft phaser according to claim 7, further comprising a phaser return spring disposed within the cover.

9. The camshaft phaser according to claim 1, wherein the selected non-return valves each include a separate spring configured to counteract an opening of the selected non-return valve.

10. The camshaft phaser according to claim 9, wherein the stator includes a plurality of recesses configured to respectively receive the separate spring of each selected non-return valve.

11. The camshaft phaser according to claim 10, wherein the separate spring of each selected non-return valve is configured to counteract the opening of the selected non-return valve via a respective preload pin.

12. The camshaft phaser according to claim 1, further comprising a central valve fluidly connected to each sub-chamber, the central valve configured to control a flow of the hydraulic fluid which rotates the rotor relative to the stator.

13. The camshaft phaser according to claim 12, wherein the feeding of the hydraulic fluid to each first sub-chamber or each second sub-chamber occurs when the central valve is in a holding position.

14. A camshaft phaser for adjusting a phase position between a crankshaft and a camshaft of a motor vehicle, the camshaft phaser comprising:

a stator, a rotor configured to rotate relative to the stator, the rotor including a plurality of blades, a plurality of working chambers formed between the stator and the rotor, the plurality of blades respectively dividing each working chamber into a first sub-chamber and a second sub-chamber which are configured to receive hydraulic fluid so as to rotate the rotor relative to the stator, and a reservoir configured to store the hydraulic fluid, the reservoir fluidly connected to:

i) each first sub-chamber via a respective first non-return valve so as to feed the hydraulic fluid to each first sub-chamber when a negative pressure is present in each first sub-chamber thereby opening each first non-return valve, and ii) each second sub-chamber via a respective second non-return valve so as to feed the hydraulic fluid to each second sub-chamber when a negative pressure is present in each second sub-chamber thereby opening each second non-return valve, wherein selected non-return valves are plastically deformed in a direction away from an open position prior to an assembly of the camshaft phaser, the selected non-return valves including each first non-return valve and/or each second non-return valve.

15. The camshaft phaser according to claim 14, wherein the selected non-return valves are plastically deformed such that:

each first non-return valve is preloaded so as to remain closed until the negative pressure in each first sub-chamber decreases below a predetermined negative pressure thereby opening each first non-return valve, and/or each second non-return valve is preloaded so as to remain closed until the negative pressure in each second sub-chamber decreases below the predetermined negative pressure thereby opening each second non-return valve.

16. The camshaft phaser according to claim 14, wherein the selected non-return valves are pressed to a closed position after the assembly of the camshaft phaser.

17. The camshaft phaser according to claim 14, further comprising a non-return valve plate on which each non-return valve is formed.

18. A camshaft phaser for adjusting a phase position between a crankshaft and a camshaft of a motor vehicle, the camshaft phaser comprising:

a stator, a rotor configured to rotate relative to the stator, the rotor including a plurality of blades, a plurality of working chambers formed between the stator and the rotor, the plurality of blades respectively dividing each working chamber into a first sub-chamber and a second sub-chamber which are configured to receive hydraulic fluid so as to rotate the rotor relative to the stator, and a reservoir configured to store the hydraulic fluid, the reservoir fluidly connected to:

i) each first sub-chamber via a respective first non-return valve so as to feed the hydraulic fluid to each first sub-chamber when a negative pressure is present in each first sub-chamber thereby opening each first non-return valve, and ii) each second sub-chamber via a respective second non-return valve so as to feed the hydraulic fluid to each second sub-chamber when a negative pressure is present in each second sub-chamber thereby opening each second non-return valve, wherein each non-return valve is resiliently formed on a common non-return valve plate, and wherein a group of selected non-return valves each include a separate spring configured to counteract an opening of the selected non-return valve, the group of selected non-return valves comprising each first non-return valve and/or each second non-return valve.

* * * * *